US011049474B2

(12) United States Patent
Kim et al.

(10) Patent No.: US 11,049,474 B2
(45) Date of Patent: Jun. 29, 2021

(54) DISPLAY DEVICE

(71) Applicant: Samsung Display Co., Ltd., Yongin-si (KR)

(72) Inventors: Kyun Ho Kim, Yongin-si (KR); Sung In Kang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/662,540

(22) Filed: Oct. 24, 2019

(65) Prior Publication Data

US 2020/0273428 A1 Aug. 27, 2020

(30) Foreign Application Priority Data

Feb. 26, 2019 (KR) ..... 10-2019-0022373

(51) Int. Cl.
*G09G 5/10* (2006.01)

(52) U.S. Cl.
CPC ..... *G09G 5/10* (2013.01); *G09G 2310/027* (2013.01); *G09G 2320/0633* (2013.01)

(58) Field of Classification Search
CPC .. G09G 5/10; G09G 3/3225; G09G 2310/027; G09G 2320/0633; G09G 2320/0626; G09G 2330/025; G09G 2330/028; G09G 2330/021; G09G 2360/16; G09G 3/32; G09G 3/3258
See application file for complete search history.

(56) References Cited

U.S. PATENT DOCUMENTS

| | | | | |
|---|---|---|---|---|
| 7,633,088 | B2 | 12/2009 | Kunjal et al. | |
| 8,248,398 | B2 | 8/2012 | Cho et al. | |
| 9,779,667 | B2 | 10/2017 | Lim et al. | |
| 2009/0033602 | A1* | 2/2009 | Alexander | G09G 3/3225 345/77 |
| 2012/0044270 | A1* | 2/2012 | Arkhipov | G09G 3/32 345/690 |
| 2013/0249955 | A1* | 9/2013 | Kim | G09G 3/3233 345/690 |

(Continued)

FOREIGN PATENT DOCUMENTS

| | | |
|---|---|---|
| KR | 10-1293571 B1 | 8/2013 |
| KR | 10-1310376 B1 | 9/2013 |

(Continued)

*Primary Examiner* — Brent D Castiaux
(74) *Attorney, Agent, or Firm* — Lewis Roca Rothgerber Christie LLP

(57) ABSTRACT

A display device includes: a display including a gate line, a data line, and a pixel electrically coupled to the gate line and the data line; a controller configured to calculate a load of input data; a data driver configured to: generate a data signal corresponding to a grayscale value in the input data; and provide the data signal to the data line; a gate driver configured to: generate a gate signal having a pulse, based on a gate-on voltage; and provide the gate signal to the gate line; and a power supply configured to: provide the gate-on voltage to the gate driver; and vary the gate-on voltage based on the load, wherein the gate-on voltage has a voltage level for turning on the first transistor, and wherein a luminance of the display is increased as the load is increased.

15 Claims, 9 Drawing Sheets

(56) References Cited

U.S. PATENT DOCUMENTS

| | | | | |
|---|---|---|---|---|
| 2013/0342585 | A1* | 12/2013 | Chun | G09G 3/3208 345/690 |
| 2016/0210930 | A1* | 7/2016 | Lee | G09G 3/3266 |
| 2016/0293101 | A1* | 10/2016 | Jeong | G09G 3/3258 |
| 2016/0314761 | A1* | 10/2016 | Kim | G09G 5/10 |

FOREIGN PATENT DOCUMENTS

| | | | |
|---|---|---|---|
| KR | 10-1319339 | B1 | 10/2013 |
| KR | 10-2015-0108443 | A | 9/2015 |

* cited by examiner

DISPLAY DEVICE

CROSS-REFERENCE TO RELATED APPLICATION

This application claims priority to and the benefit of Korean patent application 10-2019-0022373 filed on Feb. 26, 2019 in the Korean Intellectual Property Office, the entire disclosure of which is incorporated herein by reference.

BACKGROUND

1. Field

Aspects of some example embodiments of the present disclosure generally relate to a display device.

2. Related Art

A display device may display an image on a display panel by using control signals applied from the outside.

The display panel includes pixels, and each of the pixels includes a light emitting element and a driving transistor for controlling an amount of driving current flowing through the light emitting element. The light emitting element may emit light with a high luminance as the amount of driving current flowing through the light emitting element is increased. As a voltage applied between a gate electrode and one electrode of the driving transistor is increased, the amount of driving current is increased, but power consumption of the display device is also increased.

The above information disclosed in this Background section is only for enhancement of understanding of the background and therefore it may contain information that does not constitute prior art.

SUMMARY

Aspects of some example embodiments include a display device capable of emitting light with a relatively high luminance while minimizing (or maintaining relatively low) increases in average power consumption thereof.

According to some example embodiments of the present disclosure, a display device includes: a display unit including a gate line, a data line, and a pixel electrically coupled to the gate line and the data line, wherein the pixel includes a first transistor electrically coupled to the gate line; a controller configured to calculate a load of input data; a data driver configured to generate a data signal corresponding to a grayscale value included in the input data, and provide the data signal to the data line; a gate driver configured to generate a gate signal having a pulse, based on a gate-on voltage, and provide the gate signal to the gate line; and a power supply configured to provide the gate-on voltage to the gate driver, and vary the gate-on voltage, based on the load, wherein the gate-on voltage has a voltage level for turning on the first transistor, wherein a luminance of the display unit is increased as the load is increased.

According to some example embodiments, he display unit may further include a first power line and a second power line. The pixel may further include a second transistor and a light emitting element, which are electrically coupled in series between the first power line and the second power line. The first transistor may transfer the data signal to a gate electrode of the second transistor in response to the gate signal.

According to some example embodiments, each of the first and second transistors may be an N-type transistor.

According to some example embodiments, the power supply may provide the gate driver with a gate-off voltage having a voltage level for turning off the first transistor. The gate-off voltage may be constant without being varied. The power supply may linearly increase the difference between the gate-off voltage and the gate-on voltage as the load is increased.

According to some example embodiments, in a first range in which the load is smaller than a first reference load, the gate-on voltage may be a constant voltage having a first reference voltage level.

According to some example embodiments, in a second range in which the load is larger than a second reference load, the gate-on voltage may be a constant voltage having a second reference voltage level. The second reference load may be larger than the first reference load.

According to some example embodiments, the power supply may determine a target voltage level of the gate-on voltage, based on the load, and linearly change the voltage level of the gate-on voltage to the target voltage level during a reference time.

According to some example embodiments, a variation of the gate-on voltage per unit time may be constant.

According to some example embodiments, the pixel may further include a third transistor electrically coupled between a reference power line and one electrode of the light emitting element. The power supply may generate a reference voltage and supply the reference voltage to the reference power line, and vary the reference voltage, based on the load.

According to some example embodiments, the power supply may generate first power voltage and apply the first power voltage to the first power line, and vary the first power voltage, based on the load.

According to some example embodiments, the power supply may include: a voltage determiner configured to determine a target gate-on voltage, based on the load; and a first voltage generator configured to generate the gate-on voltage, based on the target gate-on voltage.

According to some example embodiments, the voltage determiner may determine each of a target reference voltage and a target power voltage, based on the load. The power supply may further include: a second voltage generator configured to generate the reference voltage, based on the target reference voltage; and a third voltage generator configured to generate the first power voltage, based on the target power voltage.

According to some example embodiments, each of the first and second transistors may be a P-type transistor.

According to some example embodiments, the power supply may linearly decrease the voltage level of the gate-on voltage as the load is increased.

According to some example embodiments of the present disclosure, a display device includes: a display unit including a gate line, a data line, and a pixel electrically coupled to the gate line and the data line, wherein the pixel includes a first transistor electrically coupled to the gate line; a data driver configured to generate a data signal corresponding to a grayscale value included in input data, and provide the data signal to the data line; a gate driver configured to generate a gate signal having a pulse, based on a gate-on voltage, and provide the gate signal to the gate line; and a power supply configured to provide the gate-on voltage to the gate driver, and vary the gate-on voltage, based on a dimming level, wherein the gate-on voltage has a voltage level for turning on the first transistor, wherein a maximum luminance of the display unit varies depending on the dimming level.

According to some example embodiments of the present disclosure, the display device varies a gate-on voltage for turning on a transistor provided in a pixel. Accordingly, the display device may display an image with a relatively high luminance while minimizing (or maintaining relatively low) increases in average power consumption thereof.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
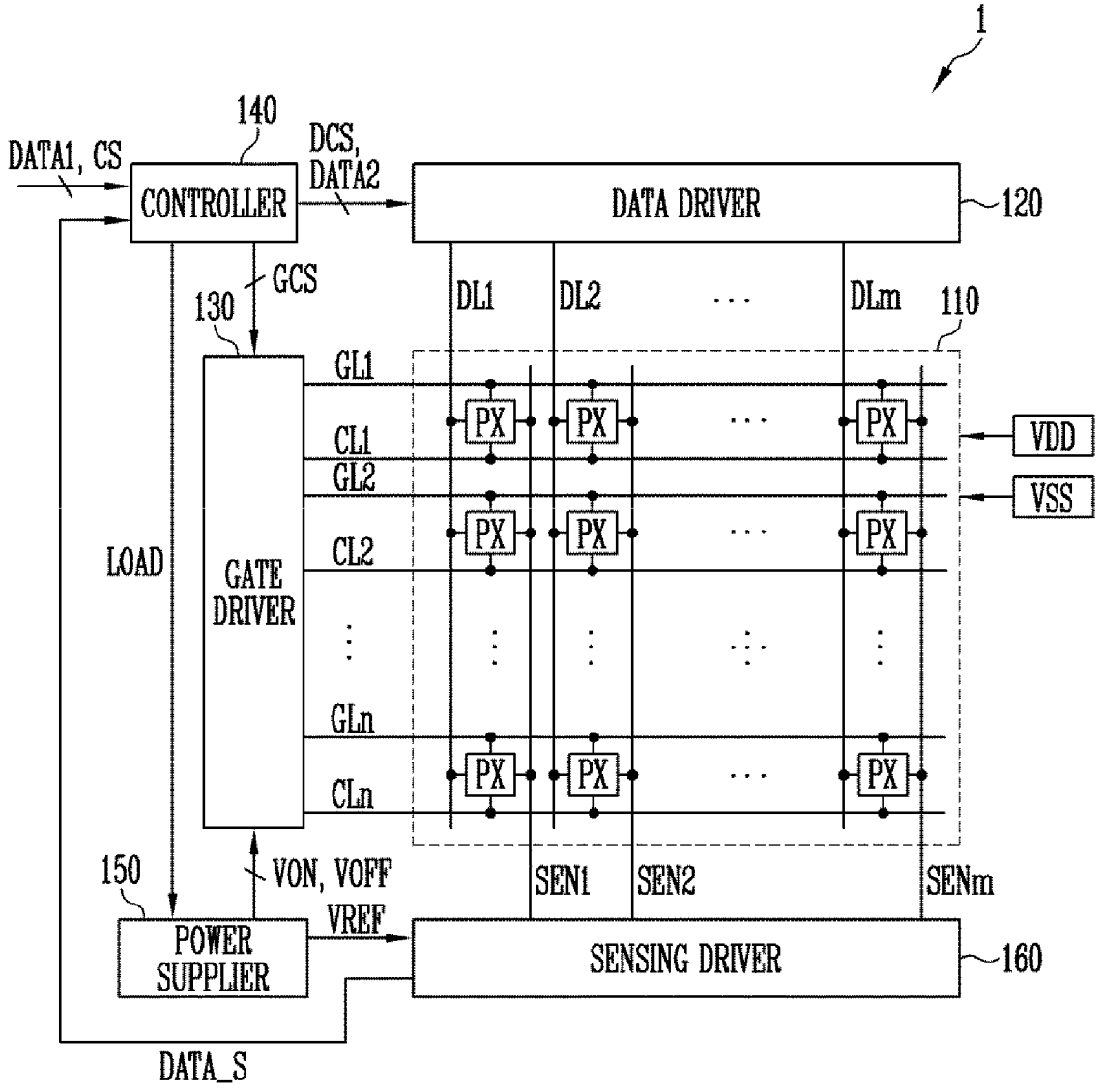
FIG. 1 is a diagram illustrating a display device according to some example embodiments of the present disclosure.

Hereinafter, aspects of some example embodiments are described in more detail with reference to the accompanying drawings so that those skilled in the art may more easily practice the present disclosure. The present disclosure may be implemented in various different forms and is not limited to the example embodiments described in the present specification.

Certain components or aspects that are not needed for a person having ordinary skill in the art to understand the description of embodiments of the invention may be omitted to more clearly describe the present disclosure, and the same or similar constituent elements will be designated by the same reference numerals throughout the specification. Therefore, the same reference numerals may be used in different drawings to identify the same or similar elements.

FIG. 1 is a diagram illustrating a display device in according to some example embodiments of the present disclosure.

Referring to FIG. 1, the display device 1 may include a display unit (or display) 110, a data driver 120, a gate driver 130, a controller 140, a power supply 150, and a sensing driver 160.

The display unit 110 may display an image. The display unit 110 may be implemented with a display panel.

The display unit 110 may include data lines DL1 to DLm (m is a positive integer), gate lines GL1 to GLn (n is a positive integer), sensing lines SEN1 to SENm (or reference power lines), control lines CL1 to CLn, and pixels PX. The pixels PX may be arranged in areas defined by the data lines DL1 to DLm and the gate lines GL1 to GLn. The pixels PX may be electrically coupled to the data lines DL1 to DLm and the gate lines GL1 to GLn. Also, the pixels PX may be electrically coupled to the sensing lines SEN1 to SENm and the control lines CL1 to CLn.

However, the pixels PX are not limited thereto. For example, the pixels PX may be electrically coupled to gate lines corresponding to adjacent rows (e.g., a gate line corresponding to a row prior to a row in which the pixel PX is included and a gate line corresponding to a row next to the row in which the pixel PX is included). According to some example embodiments, the pixels PX may be electrically coupled to a first power line and a second power line, to receive a first power voltage VDD and a second power voltage VSS respectively through the first power line and the second power line. The first power voltage VDD and the second power voltage VSS may be voltages necessary (or utilized) for driving the pixels PX.

The pixels PX may emit light with a luminance corresponding to a data signal provided through a corresponding data line, in response to a gate signal provided through a corresponding gate line. An example configuration and operation of the pixels PX will be described in more detail later with reference to FIG. 2.

The data driver 120 may generate a data signal, based on a data control signal DCS and image data DATA2, and provide the data signal to the data lines DL1 to DLm. The data control signal DCS is a signal for controlling an operation of the data driver 120, and may include a data enable signal, etc.

The gate driver 130 (or scan driver) may generate a gate signal, based on a gate control signal GCS, and provide the gate signal to the gate lines GL1 to GLn. The gate control signal GCS is a signal for controlling an operation of the gate driver 130, and may include a start signal, clock signals, etc. For example, the gate driver 130 may sequentially generate and output a gate signal corresponding to the start signal (e.g., a gate signal having a waveform identical or similar to that of the start signal) by using the clock signals. The gate driver 130 may include a shift register.

Also, the gate driver 130 may generate a control signal, based on the gate control signal GCS, and provide the control signal to the control lines CL1 to CLn. For example, the gate driver 130 may sequentially generate and output by using the clock signals. Although a case where the gate driver 130 generates the gate signal and the control signal is illustrated, a circuit for generating the control signal may be implemented with a separate driver independent from the gate driver 130.

In some embodiments, the gate driver 130 may be supplied with a gate-on voltage VON and a gate-off voltage VOFF from the power supply 150, and generate a gate signal (and a control signal) obtained by combining the gate-on voltage VON and the gate-off voltage VOFF. The gate-on voltage VON may have a voltage level for turning on a transistor provided in the pixels PX, the gate driver 130, etc., and the gate-off voltage VOFF may have a voltage level for turning off the transistor.

The controller 140 (or timing controller) may receive a control signal CS from the outside or an external source (e.g., a graphic processor), and generate the gate control signal GCS and the data control signal DCS, based on the control signal CS. The control signal CS may include a clock signal, a horizontal synchronization signal, a data enable signal, etc.

Also, the controller 140 may receive input image data DATA1 (e.g., RGB data) from the outside or an external source, and convert the input image data DATA1 into image data DATA2 suitable for pixel arrangement of the display unit 100 and then output the image data DATA2. The input image data DATA1 may include a grayscale value corresponding to the pixel PX.

In some embodiments, the controller 140 may calculate or predict a load LOAD (or load information) of the display device 1, based on the input image data DATA1. According to some example embodiments, the controller 140 may calculate a load LOAD by averaging grayscale values included in input image data DATA1 provided at a current time. According to some example embodiments, the controller 140 may determine a load LOAD by calculating an on-pixel ratio of pixels (e.g., a ratio of pixels driven corresponding to the input image data DATA1) in the display unit 110, based on the input image data DATA1. The load LOAD (or load information) may be provided to the power supply 150. Meanwhile, although a case where the controller 140 analyzes the input image data DATA1 is described, embodiments according to the present disclosure are not limited thereto.

The power supply 150 (or driving voltage generator) generates the gate-on voltage VON and the gate-off voltage VOFF, and may vary the voltage level of the gate-on voltage VON, based on the load LOAD. For example, the power supply 150 may increase the gate-on voltage VON when the load LOAD is increased (e.g., when a target luminance of the display device 1 is increased as the load LOAD is increased). An example configuration of the power supply 150 that varies the gate-on voltage VON will be described in more detail later with reference to FIG. 4.

When the gate-on voltage VON is increased, the voltage level of a gate signal (e.g., the voltage level of the gate-on voltage VON) generated by the gate driver 130 is increased, and driving current flowing through the pixel PX is increased. Therefore, the entire luminance of the display unit 110 may be increased.

In some embodiments, the power supply 150 may generate a reference voltage VREF (or initialization voltage) and provide the reference voltage VREF to the sensing driver 160. The reference voltage VREF is a voltage applied for the sensing driver 160 to sense a characteristic of the pixel PX in the display unit 110 (e.g., a voltage applied to one end of a light emitting element of the pixel PX), and may have a voltage level lower than a threshold voltage of the light emitting element.

In some embodiments, the power supply 150 may vary the reference voltage VREF, based on the load LOAD. Similarly to the gate-on voltage VON, the driving current flowing through the pixel PX may be changed depending on a change in reference voltage VREF, and therefore, the entire luminance of the display unit 110 may be changed.

The sensing driver 160 is electrically coupled to the sensing lines SEN1 to SENm, and senses deviation of each of the sensing lines SEN1 to SENm (i.e., deviation information of a channel). For example, the sensing driver 160 may sense a capacitance of a parasitic capacitor formed on each of the sensing lines SEN1 to SENm.

Meanwhile, although a case where the sensing driver 160 is electrically coupled to the sensing lines SEN1 to SENm is illustrated in FIG. 1, embodiments according to the present disclosure are not limited thereto. For example, the present disclosure may be applied to various external compensation methods currently known in the art, and the sensing driver 160 may be electrically coupled to the data lines DL1 to DLm. The sensing driver 160 may sense, as the deviation information, a capacitance of a parasitic capacitor formed on each of the data lines DL1 to DLm.

The sensing driver 160 may sense characteristic information of the pixel PX. For example, the sensing driver 160 may apply the reference voltage VREF to the sensing lines SEN1 to SENm, and sense, as the characteristic information of the pixel PX, threshold voltage information and mobility information of a driving transistor included in the pixel PX and/or degradation information of an organic light emitting diode included in the pixel PX.

The sensing driver 160 may covert the deviation information of the channel and the characteristic information of the pixel PX respectively into digital first sensing data and digital second sensing data DATA_S, and output the first sensing data and the second sensing data DATA_S. To this end, the sensing driver 160 may include an Analog Digital Converter (ADC). The first sensing data and the second sensing data DTAT_S, which are output from the sensing driver 160, may be stored in a memory device.

The first sensing data and the second sensing data DTAT_S, which are stored in the memory device, may be used in converting the input image data DATA1 such that a characteristic deviation of the pixel PX can be compensated. For example, the controller 140 may remove a deviation of the channel from the second sensing data DATA_S by using the first sensing data, and compensate for the image data DATA2 by using the second sensing data DATA_S from which the deviation of the channel is removed. The compensated image data DATA2 may be provided to the data driver 120.

Each of the data driver 120, the gate driver 130, the controller 140, the power supply 150, and the sensing driver 160 may be mounted directly on the display unit 110 in the form of at least one integrated circuit chip, may be attached to the display unit 110 in the form of a Tape Carrier Package (TCP), or may be mounted on a separate printed circuit board. Alternatively, at least one of the data driver 120, the gate driver 130, the power supply 150, and the sensing driver 160 may be integrated together with signal lines GL1 to GLn, DL1 to DLm, etc., on the display unit 110.

As described with reference to FIG. 1, the power supply 150 varies the gate-on voltage VON (and the reference voltage VREF), based on a load LOAD of the display device 1, which is calculated based on the load LOAD (i.e., the input image data DATA1), so that the entire luminance of the display unit 110 can be increased.

Meanwhile, although a case where the first power voltage VDD and the second power voltage VSS are independently provided to the display unit 110 is illustrated in FIG. 1, embodiments according to the present disclosure are not limited thereto. For example, the power supply 150 may generate the first power voltage VDD and the second power voltage VSS and provide the first power voltage VDD and the second power voltage VSS to the display unit 110. Also, the power supply 150 may vary at least one of the first power voltage VDD and the second power voltage VSS, based on the load LOAD.

Figure 2:
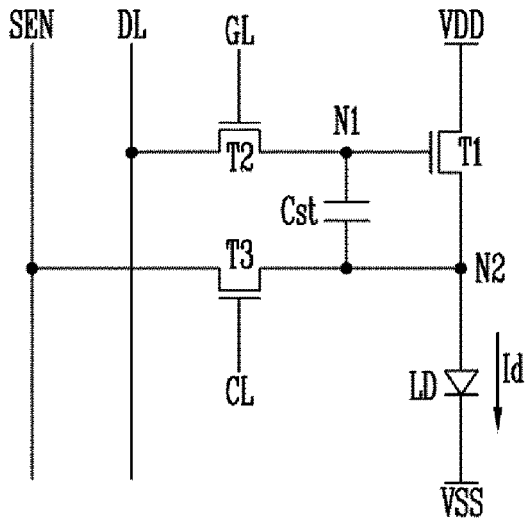
FIG. 2 is a circuit diagram illustrating an example of a pixel included in the display device shown in FIG. 1.

FIG. 2 is a circuit diagram illustrating an example of the pixel included in the display device shown in FIG. 1.

Referring to FIG. 2, the pixel PX may include a first transistor T1, a second transistor T2, a third transistor T3, a storage capacitor Cst, and a light emitting element LD.

The first to third transistors T1, T2, and T3 may be implemented with an N-type transistor (e.g., an NMOS transistor), but embodiments according to the present disclosure are not limited thereto. For example, at least one of the first to third transistors T1, T2, and T3 may be implemented with a P-type transistor (e.g., a PMOS transistor). In addition, the pixel PX may further include other transistors in addition to the first to third transistors T1, T2, and T3.

The first transistor T1 (or driving transistor) may include a first electrode electrically coupled to the first power line to which the first power voltage VDD is applied, a second electrode electrically coupled to a second node N2, and a gate electrode electrically coupled to a first node N1.

The second transistor T2 (or switching transistor) may include a first electrode electrically coupled to a data line DL, a second electrode electrically coupled to the first node N1, and a gate electrode electrically coupled to a gate line GL. The data line DL may be one of the data lines DL1 to DLm shown in FIG. 1, and the gate line GL may be one of the gate lines GL1 to GLn shown in FIG. 1.

The second transistor T2 may be turned on in response to a gate signal provided through the gate line GL, and transfer a data signal provided through the data line DL to the first node N1. For example, the gate signal may be a pulse-shaped signal or a pulse signal having a gate-on voltage VON (or turn-on voltage level) for turning on a transistor.

The storage capacitor Cst may be electrically coupled between the first node N1 and the second node N2. The storage capacitor Cst may temporarily store the data signal applied to the first node N1. The first transistor T1 may control an amount of driving current flowing through the light emitting element LD via the second node N2 from the first power line, in response to the data signal stored in the storage capacitor Cst.

The light emitting element LD (or light emitting diode) may include an anode electrode (or first pixel electrode) electrically coupled to the second node N2 and a cathode electrode (or second pixel electrode) electrically coupled to the second power line to which the second power voltage VSS is applied. For example, the light emitting element LD may be an organic light emitting diode or an inorganic light emitting diode. The light emitting element LD may emit light with a luminance corresponding to the driving current (or the amount of driving current).

The third transistor T3 (or sensing transistor) may include a first electrode electrically coupled to a sensing line SEN (or reference power line), a second electrode electrically coupled to the second node N2, and a gate electrode electrically coupled to a control line CL. The sensing line SEN may be one of the sensing lines SEN1 to SENm shown in FIG. 1, and the control line CL may be one of the control lines CL1 to CLn shown in FIG. 1.

The third transistor T3 may be turned on in response to a control signal provided through the control line CL, and transfer a reference voltage VREF provided through the sensing line SEN to the second node N2. For example, similarly to the gate signal, the control signal may be a pulse signal having a gate-on voltage VON (or turn-on voltage level) for turning on a transistor. For example, when the reference voltage VREF is applied to the second node N2, the second node N2 may be initialized by the reference voltage VREF, and a sensing current may be output to the outside through the first transistor T1, the second node N2, the third transistor T3, and the sensing line SEN from the first power line (i.e., the first power line to which the first power voltage VDD is applied). The sensing driver 160 described with reference to FIG. 1 may sense a characteristic (e.g., threshold voltage information, mobility information, etc.) of the first transistor T1, based on the sensing current.

An example operation of the pixels PX will be described in more detail with reference to FIG. 3.

Figure 3:
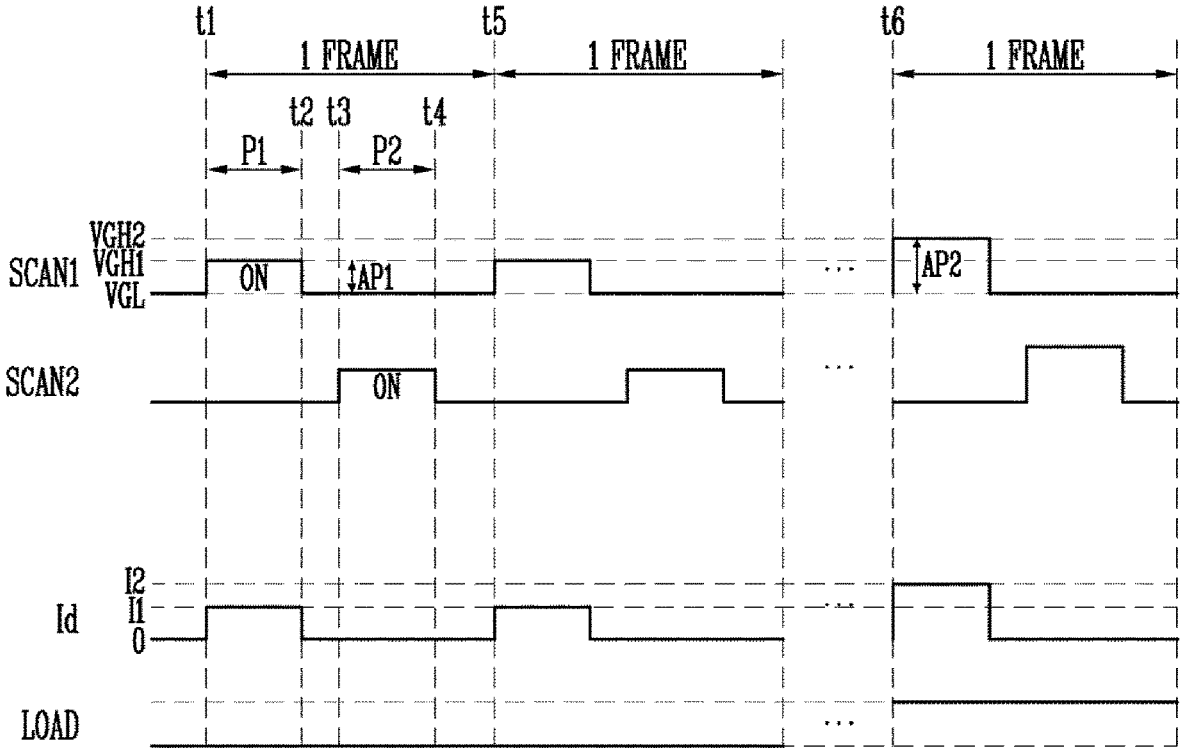
FIG. 3 is a waveform diagram illustrating an example of signals measured in the pixel shown in FIG. 2.

FIG. 3 is a waveform diagram illustrating an example of signals measured in the pixel shown in FIG. 2. In FIG. 3, a gate signal SCAN1, a control signal SCAN2, and a driving current Id according to lapse of time are illustrated.

Referring to FIGS. 2 and 3, the gate signal SCAN1 may be changed from a logic low level VGL to a first logic high level VGH1 at a first time t1, and be maintained as the first logic high level VGH1 between the first time t1 and a second time t2, i.e., during a first period P1. The logic low level VGL may be a gate-off voltage VOFF for turning off an N-type transistor, and the first logic high level VGH1 may be a gate-on voltage VON for turning on the N-type transistor. The gate signal SCAN1 having the first logic high level VGH1 may allow an NMOS transistor to be operated in a saturation region. In the first period P1, the control signal SCAN2 may have the logic low level VGL.

The second transistor T2 may be turned on in response to the gate signal SCAN1 having the first logic high level VGH1, a data signal of the data line DL may be applied to the first node N1, and the storage capacitor Cst may store or maintain the data signal. The first transistor T1 may transfer a driving current Id having a first magnitude I1 to the light emitting element LD in response to the data signal, and the light emitting element LD may emit light with a luminance corresponding to the driving current Id having the first magnitude I1.

Subsequently, at a third time t3, the gate signal SCAN1 may have the logic low level VGL, and the control signal SCAN2 may be changed from the logic low level VGL to the first logic high level VGH1. In addition, the control signal SCAN2 may be maintained as the first logic high level VGH1 between the third time t3 and a fourth time t4, i.e., during a second period P2.

The third transistor T3 may be turned on in response to the control signal SCAN2 having the first logic high level VGH1, and a reference voltage VREF of the sensing line SEN may be applied to the second node N2. A sensing current may flow through the third transistor T3 and the sensing line SEN, corresponding to the reference voltage VREF, and the sensing driver 160 described with reference to FIG. 1 may sense a characteristic of the pixel PX, based on the sensing current. Alternatively, when the third transistor T3 is turned on in response to the control signal SCAN2 having the first logic high level VGH1, a voltage of the second node N2 may be output to the outside through the sensing line SEN, and a characteristic of the pixel PX may be sensed based on the voltage of the second node N2.

Signals SCAN1 and SCAN2 at a fifth time t5 may be substantially identical to signals SCAN1 and SCAN2 at the first time t1. That is, a period between the first time t1 and the fifth time t5 may be defined as one frame 1 FRAME, and the pixel PX may be repeatedly operated in units of frames.

In some embodiments, when a load LOAD according to the input image data DATA1 applied to the display device 1 shown in FIG. 1 is increased, the voltage level of the gate-on voltage VON of the gate signal SCAN1 (and the control signal SCAN2) may be increased.

At a sixth time t6 shown in FIG. 3, the load LOAD may have a value larger than that of the load at the first time t1. For example, the average of grayscale values included in the input image data DATA1 may be increased, and a target luminance of the display device 1 (or the display unit 110) shown in FIG. 1 may be increased.

Accordingly, the gate signal SCAN1 at the sixth time t6 may have a second logic high level VGH2. The second logic high level VHG2 is a voltage level larger than the first logic high level VGH1. For example, a voltage difference AP2 of the second logic high level VGH2 with respect to the logic low level VGL may be larger than that AP1 of the first logic high level VGH1 with respect to the logic low level VGL.

The second transistor T2 may be turned on in response to the gate signal SCAN1 having the second logic high level VGH2. Theoretically, because the second transistor T2 is operated in the saturation region, an operation of the second transistor T2 according to the second logic high level VGH2 (e.g., a switching operation, an amount of current flowing according to the switching operation, and a voltage transferred according to the switching operation) may be substantially identical to that of the second transistor T2 according to the first logic high level VGH1. In addition, an operation of the pixel PX to which the gate signal SCAN1 having the second logic high level VGH2 is applied may be substantially identical to that of the pixel PX to which the gate signal SCAN1 having the first logic high level VGH1 is applied.

However, due to various causes (e.g., a material of the second transistor T2, etc.), the driving current Id having a second magnitude 12 larger than the first magnitude 11 may flow through the pixel PX (or the light emitting element LD), and the pixel PX may emit light with a higher luminance with respect to the same data (i.e., a data signal identical to that applied at the first time t1). That is, when the gate-on voltage VON of the gate signal SCAN1 is increased, the display device 1 may display an image corresponding to the same input image data DATA1 with a higher luminance.

Meanwhile, although a case where the gate-on voltage VON of the control signal SCAN2 has the second logic high level VGH2 larger than the first logic high level VGH1 when the load LOAD is increased is illustrated in FIG. 3, embodiments according to the present disclosure are not limited thereto. For example, when the gate driver 130 shown in FIG. 1 independently receives each of the gate-on voltage VON having the first logic high level VGH1 and the gate-on voltage VON having the second logic high level VGH2 from the power supply 150, the gate driver 130 may generate the control signal SCAN2 having the first logic high level VGH1, using the gate-on voltage VON having the first logic high level VGH1, regardless of the load LOAD.

Figure 4:
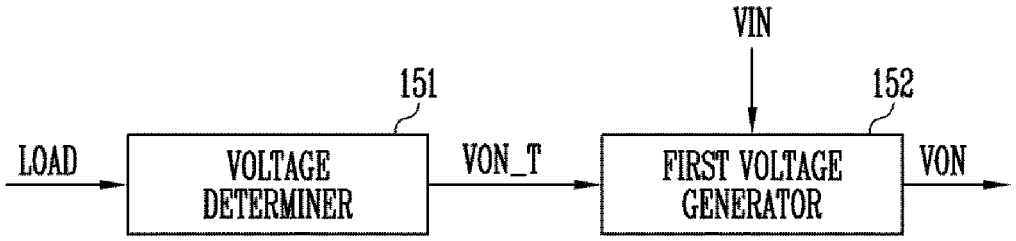
FIG. 4 is a block diagram illustrating an example of a power supply included in the display device shown in FIG. 1.

FIG. 4 is a block diagram illustrating an example of the power supply included in the display device shown in FIG. 1.

Referring to FIGS. 1 and 4, the power supply 150 may include a voltage determiner 151 and a first voltage generator 152.

The voltage determiner 151 may determine a target voltage level of the gate-on voltage VON, i.e., a target gate-on voltage VON_T, based on a load LOAD (or load information) provided from the controller 140.

The first voltage generator 152 may generate a gate-on voltage VON having a voltage level corresponding to the target gate-on voltage VON_T determined by the voltage determiner 151, i.e., having a voltage level according to the target gate-on voltage VON_T, and provide the gate-on voltage VON to the gate driver 130. According to some example embodiments, when the first voltage generator 152 is provided with a variable resistor electrically coupled to an output end thereof, the first voltage generator 152 may vary the gate-on voltage VON by linearly varying the variable resistor. According to some example embodiments, when the first voltage generator 152 is implemented with a converter including switching transistors, the first voltage generator 152 may vary the gate-on voltage VON by varying a switching speed of the switching transistors.

A more detailed operation of the voltage determiner 151 will be described with reference to FIG. 5.

Figure 5:
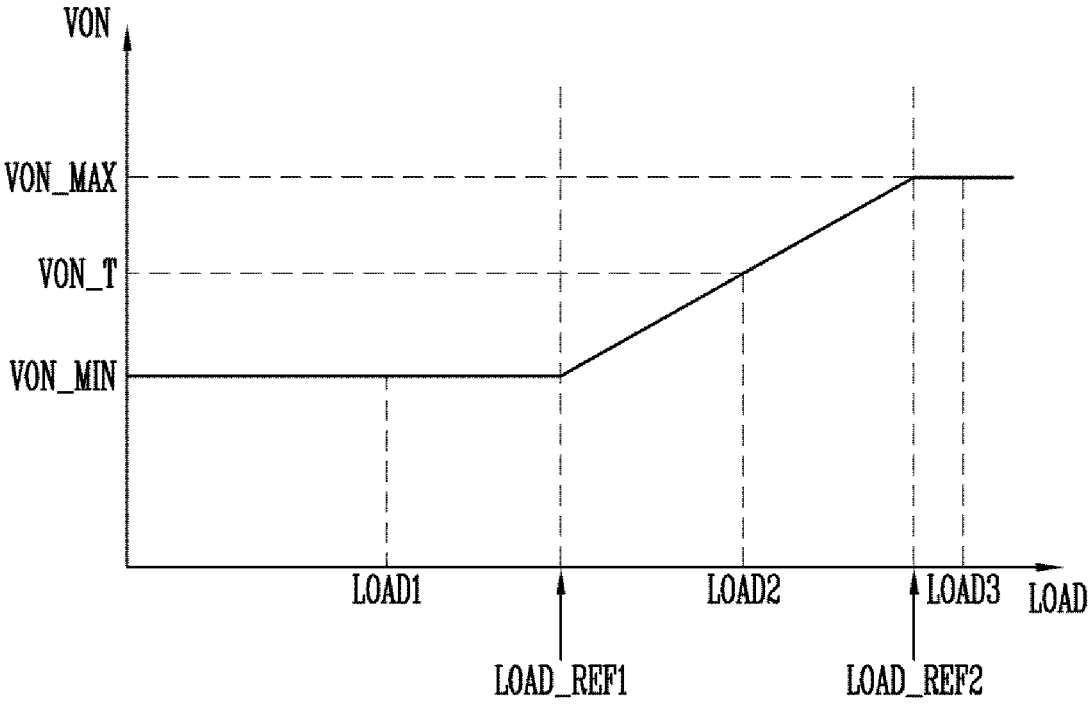
FIG. 5 is a diagram illustrating an example of determining a target gate-on voltage in the power supply shown in FIG. 4.

FIG. 5 is a diagram illustrating an example of determining a target gate-on voltage in the power supply shown in FIG. 4. In FIG. 5, change in target gate-on voltage VON_T with respect to change in load LOAD is illustrated.

Referring to FIG. 5, in a range (or period) in which the load LOAD is smaller than a first reference load LOAD_REF1 (e.g., when the load LOAD is a first load LOAD1), the voltage determiner 151 may determine a minimum gate-on voltage VON_MIN (or first reference voltage level) as the target gate-on voltage VON_T. The minimum gate-on voltage VON_MIN is a voltage having a minimum value among voltages at which a transistor is operated in the saturation region. For example, the minimum gate-on voltage VON_MIN may be 20V like a general gate-on voltage. The first reference load LOAD_REF1 is a load necessary for minimum compensation with respect to a luminance of the display device 1. For example, the first reference load LOAD_REF1 may be about 70% with respect to the maximum luminance of the display device 1.

In a range in which the load LOAD is larger than the first reference load LOAD_REF1 and is smaller than a second reference load LOAD_REF2 (e.g., when the load LOAD is a second load LOAD2), the voltage determiner 151 may linearly change the target gate-on voltage VON_T depending on the load LOAD. The second reference load LOAD_REF2 is a load necessary for maximum compensation with respect to the luminance of the display device 1. For example, the second reference load LOAD_REF2 may be about 90% with respect to the maximum luminance of the display device 1.

The voltage determiner 151 may linearly increase the target gate-on voltage VON_T from the minimum gate-on voltage VON_MIN (e.g., 20V) to a maximum gate-on voltage VON_MAX (e.g., 30V) when the load LOAD is increased from the first reference load LOAD_REF1 to the second reference load LOAD_REF2.

For example, a luminance of the display device 1 to which the gate signal SCAN1 having the minimum gate-on voltage VON_MIN (e.g., 20V) is applied may be 158 nits, a luminance of the display device 1 to which the gate signal SCAN1 having a voltage (e.g., 25V) between the minimum and maximum gate-on voltages VON_MIN and VON_MAX is applied may be 296 nits, and a luminance of the display device 1 to which the gate signal SCAN1 having the maximum gate-on voltage VON_MAX is applied may be 430 nits. That is, the luminance of the display device 1 may be increased as the gate-on voltage VON is increased.

In a range in which the load LOAD is larger than the second reference load LOAD_REF2 (e.g., when the load LOAD is a third load LOAD3), the voltage determiner 151 may the maximum gate-on voltage VON_MAX (or a second reference voltage level) as the target gate-on voltage VON_T.

As described with reference to FIG. 5, when the load LOAD is relatively large, the voltage determiner 151 linearly increases the target gate-on voltage VON_T in proportion to an increase in load LOAD, and accordingly, the first voltage generator 152 can generate and output a relatively high gate-on voltage VON.

When the gate-on voltage VON has a relatively high voltage level, stress of a transistor in the display unit 110 (or the pixel PX) may be increased, and the lifespan of the display unit 110 (or the pixel PX) may be shortened. Thus, the display device 1 adaptively varies the gate-on voltage VON depending on the load LOAD, so that an increase in stress with respect to the display unit 110 (or an increase in power consumption corresponding thereto) can be minimized, and an image can be displayed with a higher luminance, if necessary.

In some embodiments, the power supply 150 (or the first voltage generator 152) may change the gate-on voltage VON with a specific change rate or time.

A more detailed operation of the power supply 150 will be described with reference to FIG. 6.

Figure 6:
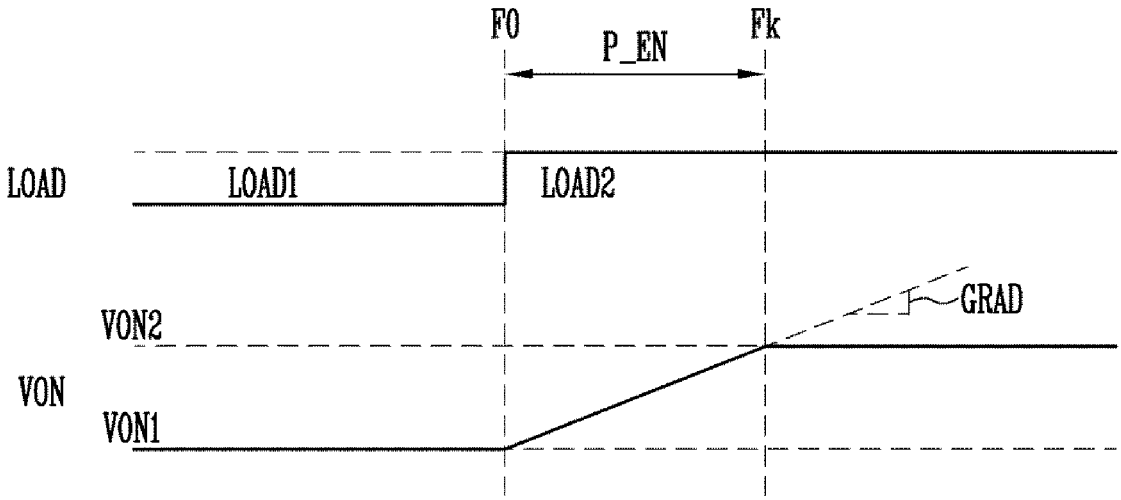
FIG. 6 is a diagram illustrating an example of a gate-on voltage output from the power supply shown in FIG. 4.

FIG. 6 is a diagram illustrating an example of the gate-on voltage output from the power supply shown in FIG. 4. In FIG. 6, change in gate-on voltage VON with respect to change in load LOAD is illustrated.

Referring to FIGS. 4 and 6, the load LOAD may be changed to the second load LOAD2 larger than the first load LOAD1 in a reference frame FO. The reference frame FO may correspond to the one frame 1 FRAME described with reference to FIG. 3. As described with reference to FIG. 5, the first load LOAD1 may be smaller than the first reference load LOAD_REF1 shown in FIG. 5, and the second load LOAD2 may be larger than the first reference load LOAD_REF1.

The power supply 150 (or the first voltage generator 152) may change the gate-on voltage VON from a first gate-on voltage VON1 (e.g., the minimum gate-on voltage VON_MIN) to a second gate-on voltage VON2 (e.g., the maximum gate-on voltage VON_MAX), based on a reference change rate GRAD. For example, the reference change rate GRAD may be 1V/FRAME, i.e., 1V per frame. When the voltage level of the gate-on voltage ON is rapidly changed, the luminance of the display device 1 is rapidly increased. Therefore, flickering of an image may be viewed by a user, or stress temporarily applied to the display device 1 may be increased. Thus, the power supply 150 gradually increases the gate-on voltage VON, so that the flickering viewed by the user and the stress temporarily applied to the display device 1 can be reduced.

Meanwhile, when the target gate-on voltage VON_T is reset while the gate-on voltage is varying, the gate-on voltage VON may vary to be identical to the reset target gate voltage VON_T with respect to a corresponding time.

In an embodiment, the power supply 150 (or the first voltage generator 152) may change the gate-on voltage VON from the first gate-on voltage VON1 (e.g., the minimum gate-on voltage VON_MIN) to the second gate-on voltage VON2 (e.g., the maximum gate-on voltage VON_MAX) during a reference time P_EN (or entry time). The reference time P_EN is a time allocated to vary the gate-on voltage VON, and may be, for example, one frame to ten frames. For example, the power supply 150 may vary the gate-on voltage VON during a time between the reference frame F0 to a kth frame Fk (k is a positive integer). Thus, flickering viewed by a user due to a rapid change in gate-on voltage VON can be prevented, and stress temporarily applied to the display device 1 can be reduced.

As described with reference to FIG. 6, the power supply 150 (or the first voltage generator 152) may gradually change the gate-on voltage, based on the reference change rate GRAD or the reference time P_EN.

Figure 7:
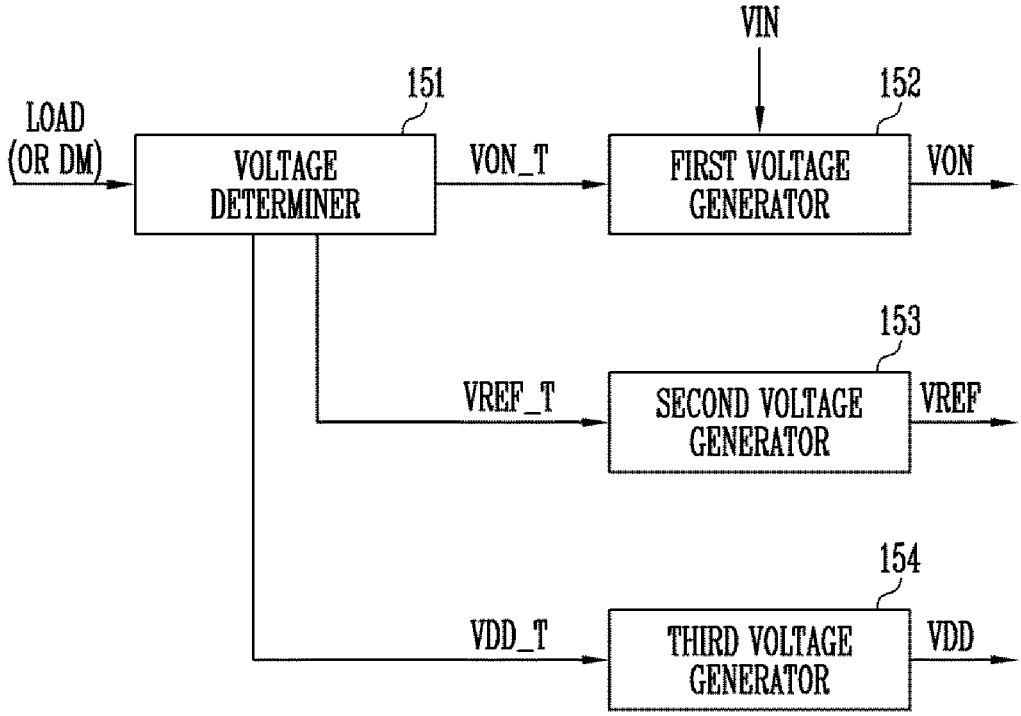
FIG. 7 is a block diagram illustrating another example of the power supply included in the display device shown in FIG. 1.

FIG. 7 is a block diagram illustrating another example of the power supply included in the display device shown in FIG. 1.

Referring to FIGS. 4 to 7, the power supply 150 shown in FIG. 7 is different from the power supply 150 shown in FIG. 4, in that the power supply 150 shown in FIG. 7 further includes a second voltage generator 153 and a third voltage generator 154.

The voltage determiner 151 may determine a target voltage level of a reference voltage VREF, i.e., a target reference voltage VREF_T, based on a load LOAD (or load information) provided from the controller 140. Also, the voltage determiner 151 may determine a target voltage level of the first power voltage VDD, i.e., a target power voltage VDD_T (or first target power voltage), based on the load LOAD.

The second voltage generator 153 may generate the reference voltage VREF corresponding to the target reference voltage VREF_T determined by the voltage determiner 151, i.e., having a voltage level according to the target reference voltage VREF_T. Similarly, the third voltage generator 154 may generate the first power voltage VDD corresponding to the target power voltage VDD_T determined by the voltage determined 151, i.e., having a voltage level according to the target power voltage VDD_T. Each of the second voltage generator 153 and the third voltage generator 154 is substantially identical or similar to the first voltage generator 152, and therefore, overlapping descriptions will be omitted to avoid redundancy.

Operations of the voltage determiner 151 and the second voltage generator 153 will be described with reference to FIG. 8.

Figure 8:
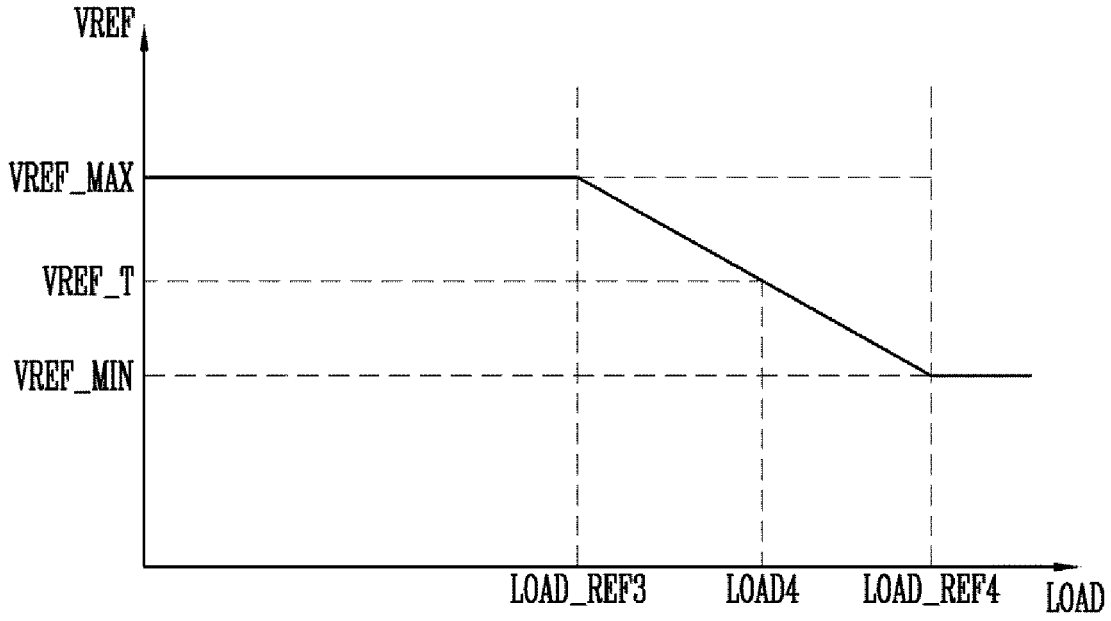
FIG. 8 is a diagram illustrating an example of determining a target reference voltage in the power supply shown in FIG. 7.

FIG. 8 is a diagram illustrating an example of determining a target reference voltage in the power supply shown in FIG. 7.

Referring to FIG. 8, when the load LOAD is smaller than a third reference load LOAD_REF3, the voltage determiner 151 may determine a maximum reference voltage VREF_MAX as the target reference voltage VREF_T. The maximum reference voltage VREF_MAX is a voltage having a maximum value among voltages smaller than the threshold voltage of the light emitting element LD. For example, the maximum reference voltage VREF_MAX may be 2.8V like a general reference voltage VREF. The third reference load LOAD_REF3 is a load necessary for a change in reference voltage VREF. According to some example embodiments, the third reference load LOAD_REF3 may be identical to the first reference load LOAD_REF1 described with reference to FIG. 5, but embodiments according to the present disclosure are not limited thereto. For example, the third reference load LOAD_REF3 may be about 80% with respect to the maximum luminance of the display device 1. According to some example embodiments, the third reference load LOAD_REF3 may be larger than the second reference load LOAD_REF2. The third reference load LOAD_REF3 is set different from the first reference load LOAD_REF1, so that stress of the display device 1 according to a change in both the gate-on voltage VON and the reference voltage VREF can be dispersed.

In a period in which the load LOAD is larger than the third reference load LOAD_REF3 and is smaller than a fourth reference load LOAD_REF4 (e.g., when the load LOAD is a fourth load LOAD4), the voltage determiner 151 may linearly change the target reference voltage VREF_T depending on the load LOAD. The fourth load LOAD4 may be identical to the second reference load LOAD_REF2 described with reference to FIG. 5, but embodiments according to the present disclosure are not limited thereto.

The voltage determiner 151 may linearly decrease the target reference voltage VREF_T from the maximum reference voltage VREF_MAX (e.g., 2.8V) to a minimum reference voltage VREF_MIN (e.g., 0.4V) when the load LOAD is increased from the third reference load LOAD_REF3 to the fourth reference load LOAD_REF4.

For example, a luminance of the display device 1 to which the reference voltage VREF having the maximum reference voltage VREF_MAX (e.g., 2.8V) is applied may be 395 nits, a luminance of the display device 1 to which the reference voltage VREF having a voltage (e.g., 2V or 1.2V) between the minimum and maximum reference voltages VREF_MIN and VREF_MAX is applied may be 510 nits to 607 nits, and a luminance of the display device 1 to which the reference voltage VREF having the minimum reference voltage VREF_MIN is applied may be 715 nits. That is, the luminance of the display device 1 may be increased as the reference voltage VREF is decreased.

When the load LOAD is the third load LOAD3 larger than the fourth reference load LOAD_REF4, the voltage determiner 151 may determine the minimum reference voltage VREF_MIN as the target reference voltage VREF_T.

Similarly to the first voltage generator 152, the second voltage generator 153 may gradually change the reference voltage VREF with a specific change rate or entry time.

As described with reference to FIG. 8, when the load LOAD is relatively large, the voltage determiner 151 linearly decreases the target reference voltage VREF_T in proportion to an increase in load LOAD, and accordingly, the second voltage generator 153 can generate and output a relatively low reference voltage VREF.

Operations of the voltage determiner 151 and the third voltage generator 154 will be described with reference to FIG. 9.

Figure 9:
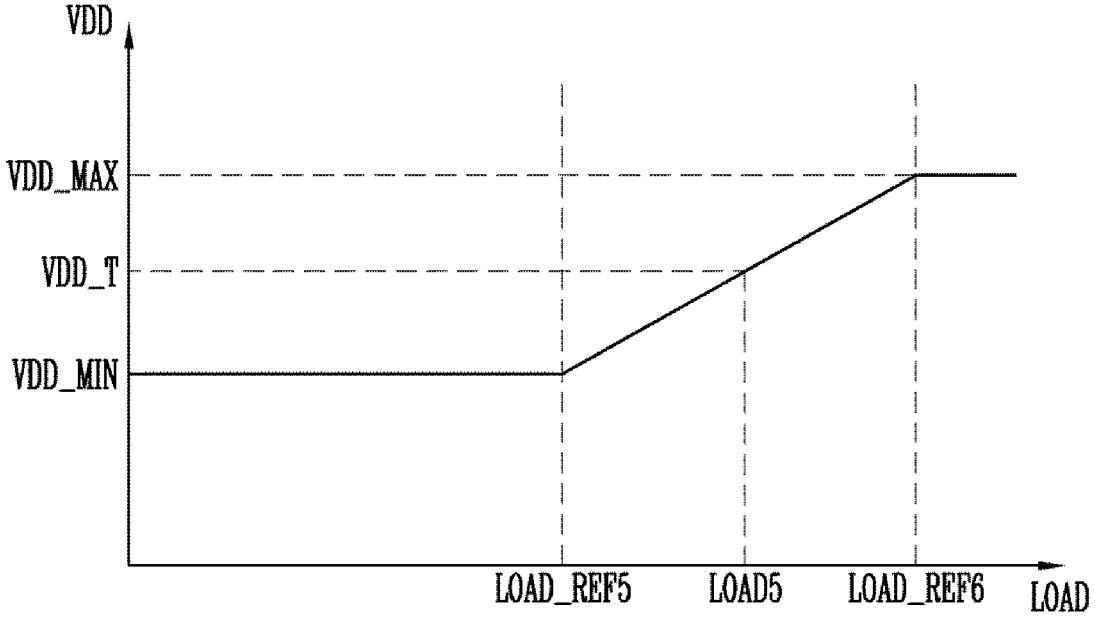
FIG. 9 is a diagram illustrating an example of determining a target power voltage in the power supply shown in FIG. 7.

FIG. 9 is a diagram illustrating an example of determining a target power voltage in the power supply shown in FIG. 7.

Referring to FIG. 9, when the load LOAD is smaller than a fifth reference load LOAD_REF5, the voltage determiner 151 may determine a minimum power voltage VDD_MIN as the target power voltage VDD_T. The fifth reference load LOAD_REF5 may be identical to the first reference load LOAD_REF1 described with reference to FIG. 5 or be identical to the third reference load LOAD_REF3 described with reference to FIG. 8, but embodiments according to the present disclosure are not limited thereto. For example, the fifth reference load LOAD_REF5 may be larger than the fourth reference load LOAD_REF4.

In a period in which the load LOAD is larger than the fifth reference load LOAD_REF5 and is smaller than a sixth reference load LOAD_REF6 (e.g., when the load LOAD is a fifth load LOAD5), the voltage determiner 151 may linearly change the target power voltage VDD_T depending on the load LOAD. The sixth reference load LOAD_REF6 may be identical to the first reference load LOAD_REF1 described with reference to FIG. 5 or be identical to the third reference load LOAD_REF3 described with reference to FIG. 8, but embodiments according to the present disclosure are not limited thereto.

The voltage determiner 151 may linearly increase the target power voltage VDD_T from the minimum power voltage VDD_MIN (e.g., 22V) to a maximum power voltage VDD_MAX (e.g., 26V) when the load LOAD is increased from the fifth reference load LOAD_REF5 to the sixth reference load LOAD_REF6.

For example, a luminance of the display device 1 to which the minimum power voltage VDD_MIN (e.g., 22V) is applied may be 262 nits, a luminance of the display device 1 to which a power voltage (e.g., 24V) between the minimum and maximum power voltages VDD_MIN and VDD_MAX is applied may be 296 nits, and a luminance of the display device 1 to which the maximum power voltage VDD_MAX is applied may be 330 nits. That is, the luminance of the display device 1 may be increased as the power voltage VDD is decreased.

When the load LOAD is larger than the sixth reference load LOAD_REF6, the voltage determiner 151 may determine the maximum power voltage VDD_MAX as the target power voltage VDD_T.

Similarly to the first voltage generator 152, the third voltage generator 154 may gradually change the power voltage VDD with a specific change rate or entry time.

As described with reference to FIG. 9, when the load LOAD is relatively large, the voltage determiner 151 linearly increases the power voltage VDD in proportion to an increase in load LOAD, and accordingly, the third voltage generator 154 can generate and output a relatively high power voltage VDD.

Meanwhile, the power supply 150 may sequentially vary the gate-on voltage VON, the reference voltage VREF, and the first power voltage VDD. For example, the power supply 150 may primarily or preferentially vary (or increase) the gate-on voltage as the load LOAD is increased. Subsequently, the power supply 150 may secondarily vary (or decrease) the reference voltage VREF as the load LOAD is further increased. Subsequently, the power supply 150 may vary (or increase) the first power voltage VDD as the load LOAD is further increased.

Figure 10:
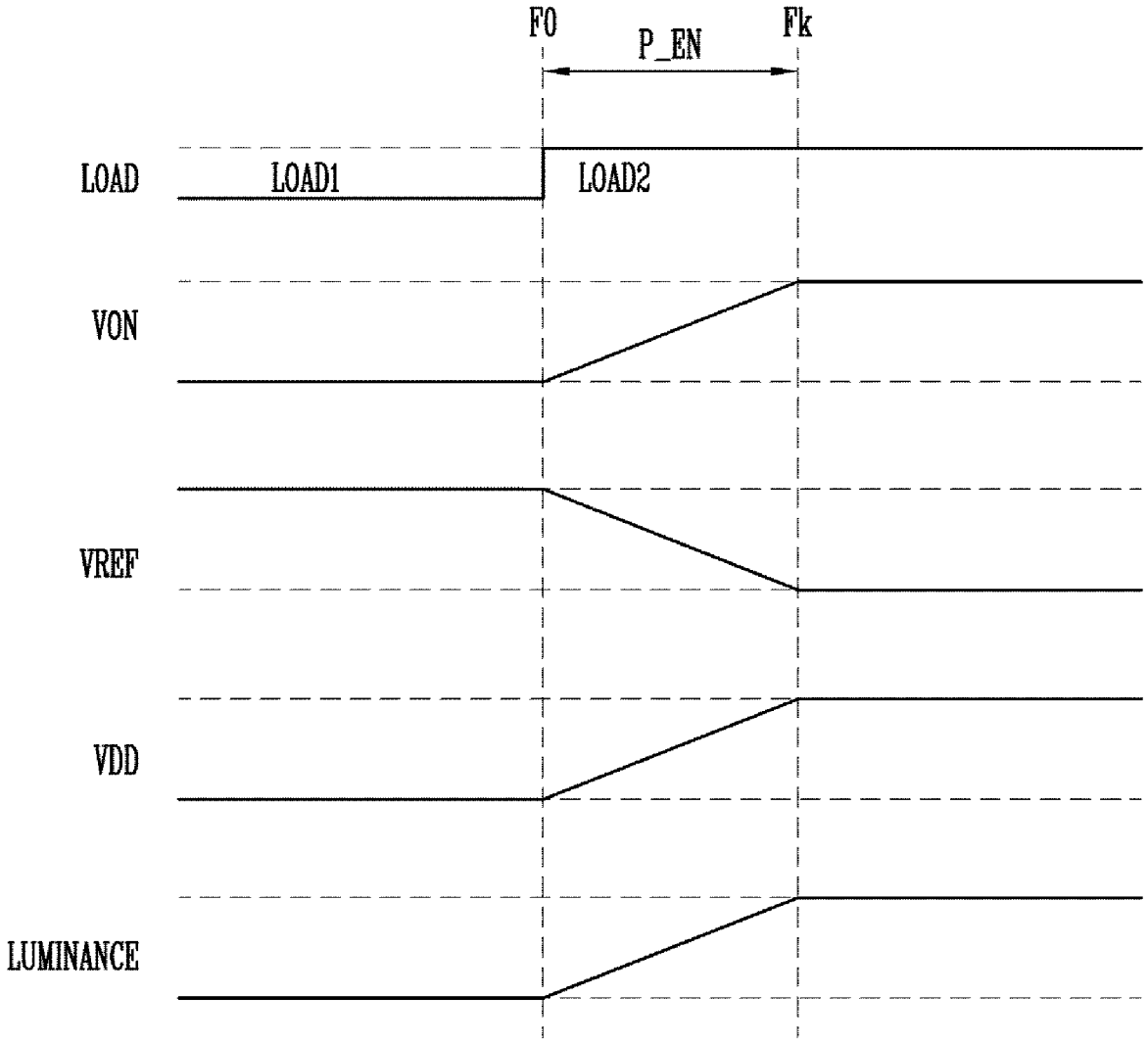
FIG. 10 is a diagram illustrating an example of voltages output from the power supply shown in FIG. 7.

FIG. 10 is a diagram illustrating an example of voltages output from the power supply shown in FIG. 7. In FIG. 10, change in gate-on voltage VON, change in reference voltage VREF, and change in first power voltage VDD with respect to change in load LOAD are illustrated.

Referring to FIGS. 7 and 10, the load LOAD may be changed to the second load LOAD2 larger than the first load LOAD1 in a reference frame F0.

The first voltage generator 152 may change (or increase) the gate-on voltage VON, based on a first reference change rate or reference time P_EN. The reference change rate or reference time P_EN may be substantially identical to the reference change rate GRAD and the reference time P_EN, which are described with reference to FIG. 6, respectively.

Similarly, the second voltage generator 153 may change (or decrease) the reference voltage VREF, based on a second reference change rate or reference time P_EN, and the third voltage generator 154 may change (or increase) the first power voltage VDD, based on a third reference change rate or reference time P_EN.

Accordingly, the entire luminance of the display device can be gradually increased based on a specific change rate or during a reference time P_EN, e.g., during ten frames.

For example, the display device 1 may display an image by using a gate-on voltage VON of 25V, a reference voltage VREF of 2V, and a first power voltage VDD of 13.5V according to the first load LOAD1. Also, the display device 1 may display an image with a higher luminance by using a gate-on voltage VON of 29V, a reference voltage VREF of 1V, and a first power voltage VDD of 14.5V according to the second load LOAD2.

Figure 11:
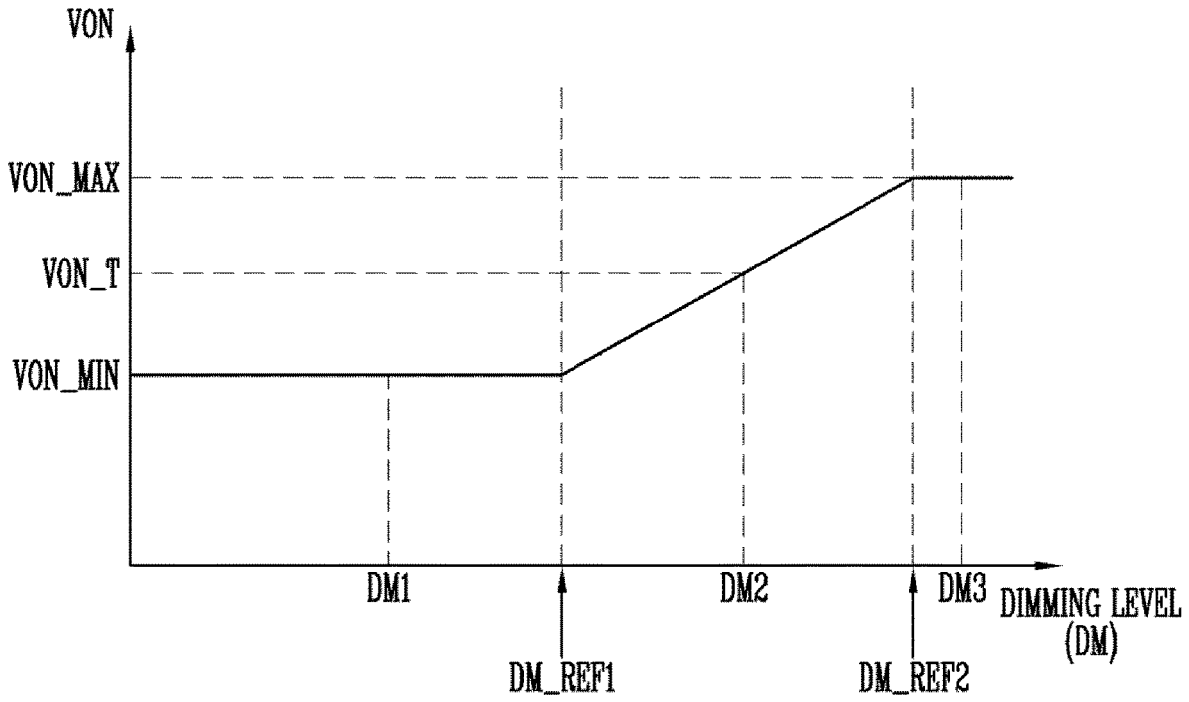
FIG. 11 is a diagram illustrating an example of determining a target gate-on voltage in the power supply shown in FIG. 7.

FIG. 11 is a diagram illustrating an example of determining a target gate-on voltage in the power supply shown in FIG. 7.

Referring to FIGS. 7 to 11, the voltage determiner 151 may determine a target gate-on voltage VON_T, based on a dimming level DM of the display device 1. The dimming level DM may define a maximum luminance (or maximum display luminance) of the display device 1, and one dimming level among a plurality of dimming levels may be determined based on an external input or display environment. For example, the maximum luminance of the display device 1 may be increased as the dimming level DM is increased.

As shown in FIG. 11, when the dimming level DM is smaller than a first reference dimming level DM_REF1 (e.g., in a first dimming level DM1), the voltage determiner 151 may determine a minimum gate-on voltage VON_MIN as the target gate-on voltage VON_T. The first reference dimming level DM_REF1 is a dimming level necessary for minimum compensation with respect to a luminance of the display device 1. For example, the first reference dimming level DM_REF1 may have a luminance of about 70% with respect to the maximum luminance of the display device 1.

In a period in which the dimming level DM is larger than the first reference dimming level DM_REF1 and is smaller than a second reference dimming level DM_REF2 (e.g., in a second dimming level DM2), the voltage determiner 151 may linearly change the target gate-on voltage VON_T depending on the dimming level DM. The second reference dimming level DM_REF2 is a dimming level necessary for maximum compensation with the luminance of the display device 1. For example, the second reference dimming level DM_REF2 may have a luminance of about 99% with respect to the maximum luminance of the display device 1.

The voltage determiner 151 may linearly increase the target gate-on voltage VON_T from the minimum gate-on voltage VON_MIN (e.g., 20V) to a maximum gate-on voltage VON_MAX (e.g., 30V) when the dimming level DM is increased from the first reference dimming level DM_REF1 to the second reference dimming level DM_REF2.

When the dimming level DM is larger than the second reference dimming level DM_REF2 (e.g., in a third dimming level DM3), the voltage determiner 151 may determine the maximum gate-on voltage VON_MAX as the target gate-on voltage VON_T.

As described with reference to FIG. 11, when the dimming level is relatively large, the voltage determiner 151 linearly increases the target gate-on voltage VON_T in proportion to an increase in dimming level DM, and accordingly, the first voltage generator 152 can generate and output a relatively high gate-on voltage VON.

Similarly, the voltage determiner 151 may determine each of the target reference voltage VREF_T and the target power voltage VDD_T, based on the dimming level DM of the display device 1.

Figure 12:
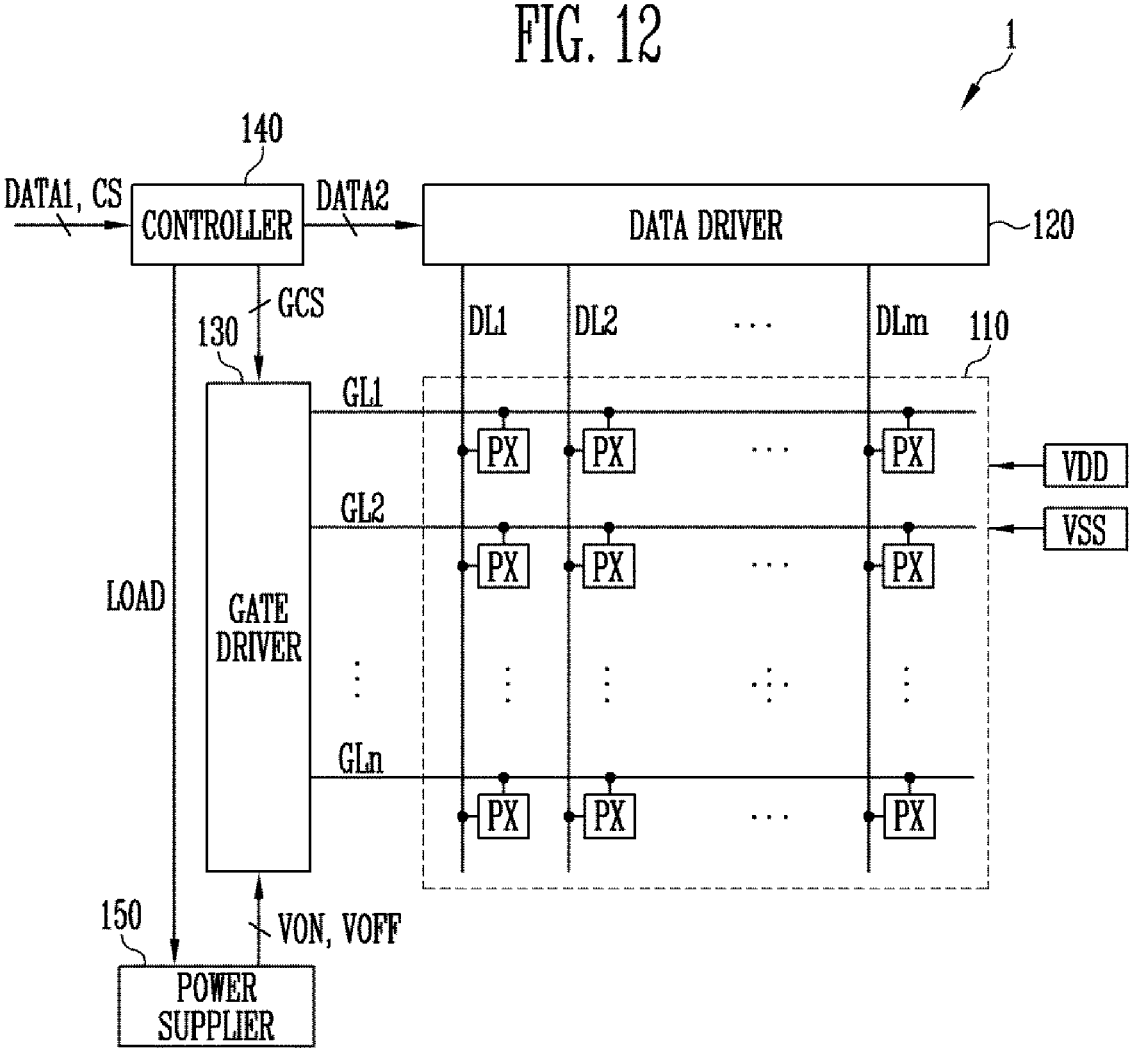
FIG. 12 is a diagram illustrating a display device in according to some example embodiments of the present disclosure.
Figure 13:
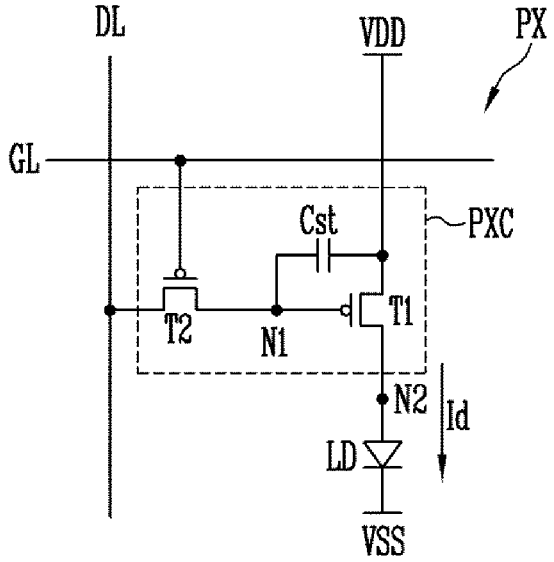
FIG. 13 is a circuit diagram illustrating an example of a pixel included in the display device shown in FIG. 12.

FIG. 12 is a diagram illustrating a display device in accordance with another embodiment of the present disclosure. FIG. 13 is a circuit diagram illustrating an example of a pixel included in the display device shown in FIG. 12.

First, referring to FIGS. 1 and 12, the display device 1 shown in FIG. 12 is different from the display device 1 shown in FIG. 1 in that the display device 1 shown in FIG. 12 does not include the sensing driver 160. The display device 1 shown in FIG. 12 is substantially identical or similar to the display device 1 shown in FIG. 1, except the sensing driver 160 and a circuit configuration (e.g., an external compensation circuit) related thereto, and therefore, overlapping descriptions will be omitted to avoid redundancy.

The display unit 110 may include data lines DL1 to DLm (m is a positive integer), gate lines GL1 to GLn (n is a positive integer), and pixels PX. The pixels PX may be arranged in areas defined by the data lines DL1 to DLm and the gate lines GL1 to GLn, and be electrically coupled to the data lines DL1 to DLm and the gate lines GL1 to GLn.

Referring to FIG. 13, the pixel PX may include a first transistor T1, a second transistor T2, a storage capacitor Cst, and a light emitting element LD.

The first and second transistors T1 and T2 may be implemented with a P-type transistor (e.g., a PMOS transistor), but embodiments according to the present disclosure are not limited thereto. For example, at least one of the first and second transistors T1 and T2 may be implemented with an N-type transistor (e.g., an NMOS transistor). In addition, the pixels PX may further include other transistors in addition to the first and second transistors T1 and T2.

A coupling configuration of the first and second transistors T1 and T2 is substantially identical to that of the first and second transistors T1 and T2 described with reference to FIG. 2, and therefore, overlapping descriptions will be omitted to avoid redundancy.

When the second transistor T2 is implemented with the P-type transistor, the second transistor T2 may be turned on based on a gate-on voltage VON having a logic low level VGL (see FIG. 3) instead of a logic high level.

The storage capacitor Cst may be electrically coupled between a first node N1 and a first power line (i.e., a power line for transferring the first power voltage VDD). The storage capacitor Cst may temporarily store a data signal applied to the first node N1.

The light emitting element LD (or light emitting diode) may be electrically coupled between a second node N2 and a second power line (i.e., a power line to which the second power voltage VSS is applied), and emit light with a luminance corresponding to a driving current Id (or data signal) provided through the first transistor T1.

An example operation of the pixel PX shown in FIG. 13 will be described in more detail with reference to FIG. 14.

Figure 14:
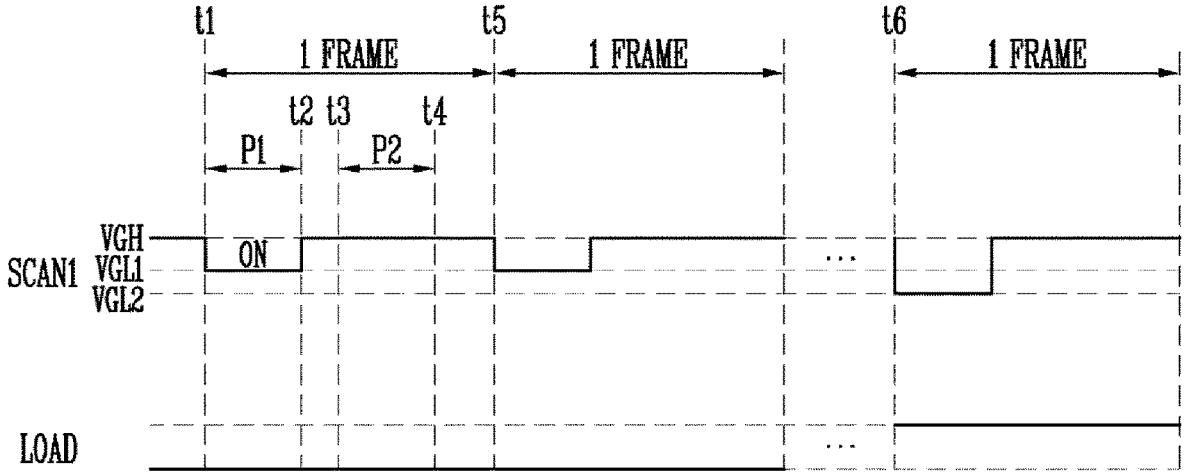
FIG. 14 is a waveform diagram illustrating an example of signals measured in the pixel shown in FIG. 13.

FIG. 14 is a waveform diagram illustrating an example of signals measured in the pixel shown in FIG. 13.

Referring to FIGS. 3 and 14, a gate signal SCAN1 (or a change in gate signal SCAN1 and an operation of the pixel PX according thereto) is substantially identical or similar to the gate signal SCAN1 (or the change in gate signal SCAN1 and the operation of the pixel according thereto) described with reference to FIG. 3, except that the gate signal SCAN1 has a first logic low level VGL1 as the gate-on voltage VON and has a logic high level VGH as the gate-off voltage VOFF, and therefore, overlapping descriptions will be omitted to avoid redundancy.

At a sixth time t6 shown in FIG. 14, a load LOAD may have a value larger than that of the load LOAD at a first time t1.

Accordingly, the gate signal SCAN1 may have a second logic low level VGL2 lower than the first logic low level VGL1 at the sixth time t6. The second logic low level VGL2 may have a voltage difference larger than that of the first logic low level VGL1 with respect to the logic high level VGH (or gate-off voltage).

As described with reference to FIG. 3, the display device 1 can display an image corresponding to the same input image data DATA1 with a higher luminance as the gate-on voltage VON of the gate signal SCAN1 is decreased (or as the voltage difference or magnitude of the gate-on voltage VON is increased with respect to the gate-off voltage VOFF).

As described with reference to FIGS. 12 to 14, a configuration for increasing the luminance of the display device 1 by varying the gate-on voltage VON may be applied to the display device 1 that does not include the sensing driver 160, and be applied to the display device 1 including various pixel circuits (e.g., a pixel circuit including an N-type transistor or P-type transistor).

Meanwhile, the power supply described with reference to FIGS. 4 and 7 and the operation of the power supply 150, which is described with reference to FIGS. 5, 6, and 8 to 10, may be applied to the power supply 150 shown in FIG. 12.

Aspects of some example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and their equivalents.

What is claimed is:

1. A display device comprising:

a display unit including a gate line, a data line, and a pixel electrically coupled to the gate line and the data line, wherein the pixel includes a first transistor electrically coupled to the gate line;

a controller configured to calculate a load of input data;

a data driver configured to:

generate a data signal corresponding to a grayscale value in the input data; and provide the data signal to the data line;

a gate driver configured to:

generate a gate signal having a pulse, based on a gate-on voltage; and provide the gate signal to the gate line; and a power supply configured to:

provide the gate-on voltage to the gate driver; and vary the gate-on voltage based on the load, wherein the gate-on voltage has a voltage level for turning on the first transistor, wherein a luminance of the display unit is increased as the load is increased, and wherein a voltage level of the gate signal provided to the gate line varies according to a variation of the gate-on voltage.

2. The display device of claim 1, wherein the display unit further includes a first power line and a second power line, wherein the pixel further includes a second transistor and a light emitting element, which are electrically coupled in series between the first power line and the second power line, and wherein the first transistor is configured to transfer the data signal to a gate electrode of the second transistor in response to the gate signal.

3. The display device of claim 2, wherein each of the first and second transistors is an N-type transistor.

4. The display device of claim 2, wherein the power supply is configured to provide the gate driver with a gate-off voltage having a voltage level for turning off the first transistor, wherein the gate-off voltage is constant without being varied, and wherein the power supply linearly increases a difference between the gate-off voltage and the gate-on voltage as the load is increased.

5. The display device of claim 4, wherein, in a first range in which the load is smaller than a first reference load, the gate-on voltage is a constant voltage having a first reference voltage level.

6. The display device of claim 5, wherein, in a second range in which the load is larger than a second reference load, the gate-on voltage is a constant voltage having a second reference voltage level, and wherein the second reference load is larger than the first reference load.

7. The display device of claim 4, wherein the power supply is configured to:

determine a target voltage level of the gate-on voltage based on the load; and linearly change the voltage level of the gate-on voltage to the target voltage level during a reference time.

8. The display device of claim 4, wherein the variation of the gate-on voltage per unit time is constant.

9. The display device of claim 4, wherein the pixel further includes a third transistor electrically coupled between a reference power line and one electrode of the light emitting element, and wherein the power supply is configured to:

generates a reference voltage;

supply the reference voltage to the reference power line; and vary the reference voltage based on the load.

10. The display device of claim 9, wherein the power supply is configured to:

generate a first power voltage;

apply the first power voltage to the first power line; and vary the first power voltage based on the load.

11. The display device of claim 10, wherein the power supply includes:

a voltage determiner configured to determine a target gate-on voltage based on the load; and a first voltage generator configured to generate the gate-on voltage based on the target gate-on voltage.

12. The display device of claim 11, wherein the voltage determiner is configured to respectively determine a target reference voltage and a target power voltage based on the load, wherein the power supply further includes:

a second voltage generator configured to generate the reference voltage, based on the target reference voltage; and a third voltage generator configured to generate the first power voltage, based on the target power voltage.

13. The display device of claim 2, wherein each of the first and second transistors is a P-type transistor.

14. The display device of claim 13, wherein the power supply is configured to linearly decrease the voltage level of the gate-on voltage as the load is increased.

15. A display device comprising:

a display unit including a gate line, a data line, and a pixel electrically coupled to the gate line and the data line, wherein the pixel includes a first transistor electrically coupled to the gate line;

a data driver configured to:

generate a data signal corresponding to a grayscale value in input data; and provide the data signal to the data line;

a gate driver configured to:

generate a gate signal having a pulse based on a gate-on voltage; and provide the gate signal to the gate line; and a power supply configured to:

provide the gate-on voltage to the gate driver; and vary the gate-on voltage based on a dimming level, wherein the gate-on voltage has a voltage level for turning on the first transistor, wherein a maximum luminance of the display unit varies depending on the dimming level, and wherein a voltage level of the gate signal provided to the gate line varies according to a variation of the gate-on voltage.

* * * * *